United States Patent [19]

Vahlbrauk

[11] 4,275,536

[45] Jun. 30, 1981

[54] WALL ELEMENT FOR A CONSTRUCTION WALL

[76] Inventor: Karl H. Vahlbrauk, Kriegerweg 1, 3353 Bad Gandersheim, Fed. Rep. of Germany

[21] Appl. No.: 102,853

[22] Filed: Dec. 11, 1979

[30] Foreign Application Priority Data

Dec. 30, 1978 [DE] Fed. Rep. of Germany ..... 2856851

[51] Int. Cl.[3] ..... E04B 5/48

[52] U.S. Cl. ..... 52/220; 52/303; 52/607

[58] Field of Search ..... 52/34, 35, 220, 221, 52/607, 293, 303

[56] References Cited

U.S. PATENT DOCUMENTS

| | | | |
|---|---|---|---|
| 1,746,816 | 2/1930 | Boes | 52/607 |
| 1,785,499 | 12/1930 | Sayers | 52/607 X |
| 2,811,850 | 11/1957 | Clary | 52/220 X |
| 3,408,784 | 11/1968 | Crowley | 52/293 X |
| 3,821,818 | 7/1974 | Alosi | 52/34 X |
| 4,010,581 | 3/1977 | Keturi et al. | 52/220 |

*Primary Examiner*—Carl D. Friedman

*Attorney, Agent, or Firm*—Michael J. Striker

[57] ABSTRACT

A wall element for a construction wall to be associated with sanitary objects, has a body portion of self-supporting material, and provided with a channel-shaped gas-tight and water-tight inner hollow which forms a conduit for at least draining. The inner hollow is provided in the region of the body portion which normally serves for the connection of said sanitary objects, and has a height corresponding to the region of the requisite draining lines of said sanitary objects. The inner hollow has an inclined sole.

13 Claims, 1 Drawing Figure

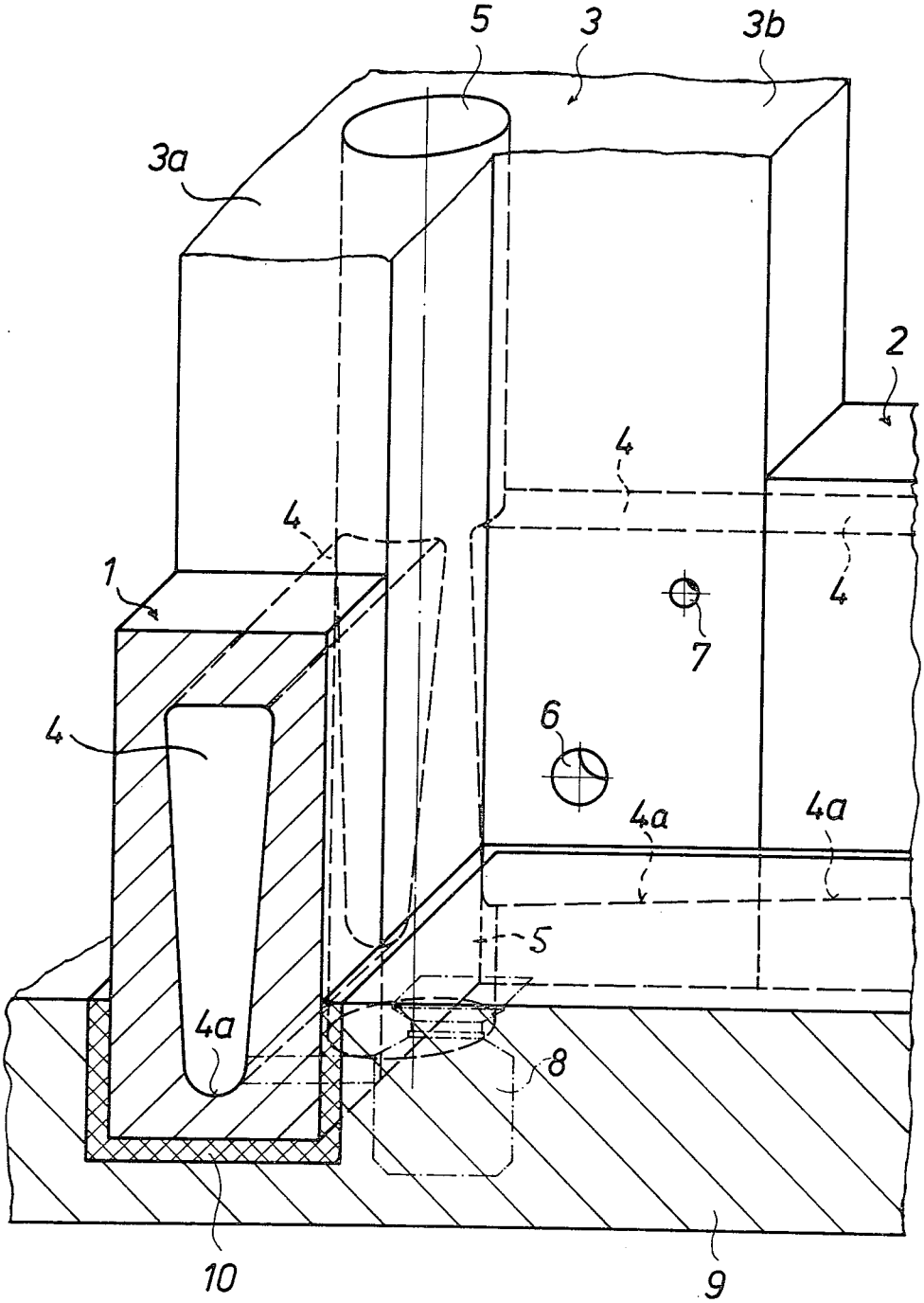
5
3
3b
3a
2
4
4
4
1
7
6
4
4a
4a
5
4a
8
10
9

WALL ELEMENT FOR A CONSTRUCTION WALL

BACKGROUND OF THE INVENTION

The present invention relates to a wall element for a construction wall. More particularly it relates to a shaped wall element of self-supporting material, provided with at least a draining conduit and suitable of forming water-containing units.

A great variety of different construction wall elements or construction floor elements are known in the art. They are generally composed of a carrying frame in which conduits are formed by a bundle of pipes inserted into and retained in the frame, and which are then coated by plates or the like. It is also known to embed the bundle of pipes in light concrete or synthetic plastic foam material. Wall elements are further known which serve for floor draining and are formed as concrete prefabricated parts in which draining pipes are also embedded (as disclosed, for example, in the German Offenlegungsschrift No. 2,424,213).

All the above-mentioned constructions possess the disadvantage in that, not only for supply conduits but also particularly for draining conduits, special circular pipes with specific connections and branchings are required. This results in that the connection fixing points for sanitary objects to be mounted, must be exactly known before the erection in order to make possible skilled dimensioning of the pipe diameter, the inclined lines and particularly the branchings and connections. However, this means both for planing and for manufacturing that the specific determination of the pipe cross-section, lines inclination, as well as connecting and collecting conduits for particular sanitary objects, cannot be dispensed with. This excludes integration of pipe technique into the pipe draining system, particularly in the event of the manufacture of prefabricated parts, and thereby free selection of sanitary objects location after laying of conduits. Thereby the known structural solutions are not suitable for large-scale series production of commercially available prefabricated products, which is necessary for industrialization of the technical services of constructions. It has been shown that in accordance with the requirements which are made now in large residential construction and construction of prefabricated houses, the installation of services is no longer a secondary object which must be taken care after the completion of the building, but is a primary object which must exactly correspond to the building. These changes in the commercial and technical concepts are a result of the fact that the costs of the technical services considerably increased, the wages became higher, on the one hand, and the inhabitants desires to have individual constructions are of great importance, on the other hand.

SUMMARY OF THE INVENTION

Accordingly, it is an object of the present invention to provide a wall element for a construction wall which avoids the disadvantages of the prior art.

More particularly, it is an object of the present invention to provide a wall element for a construction wall, which can be industrially manufactured in high quantities, on the one hand, and provides for unlimited selection for the arrangement of sanitary objects, on the other hand.

It is another object of the present invention to provide a wall element for a construction wall in which circular pipes in the region of draining with accompanying disadvantages are completely eliminated.

In keeping with these objects and with others which will become apparent hereinafter, one feature of the present invention resides, briefly stated, in a wall element which has a body portion of self-supporting material and means for forming at least one conduit for at least draining which means includes a channel-shaped gas-tight and water-tight inner hollow provided in a region of the body portion which normally serves for the connection of said sanitary objects, wherein the inner hollow has a height corresponding to the region of the reqisite draining lines of said sanitary objects and is provided with an inclined sole.

When the wall element is designed in accordance with the present invention, special pipes serving as channels for draining are completely eliminated, and instead of this the wall element has inner hollow which form these channels. The dimensions of these inner hollows provide for practically unlimited selection for arrangement of respective sanitary objects by a customer. The required connecting conduits in the wall element can be produced directly in situ as bores which lead to the inner hollows. The region of the inner hollows is such that it guarantees any number and arrangement of such connections for the sanitary objects. The arrangement of water-using units in such wall elements is completely independent of sanitary objects which is highly advantageous for the purposes of industrialization of the technical construction and simultaneously makes possible industrial manufacture in high quantites. This is because the wall element is provided with inner hollows and may be installed directly in situ without fixed determination of points of connection with the sanitary objects.

The inventive wall element can be so arranged in a construction that a sole of the inner hollow is located below the upper edge of a floor, whereby all connections of the objects including the drainage can be provided in any spatial arrangement. The height of the inner hollow is determined by the highest connecting point of a draining pipe, for example, by the connecting point for a washing basin odor seal. By respective dimensioning of the inner hollows, high air exchange takes place, which facilitates the flow of draining water without problems, particularly excluding emptying the odor sealing member during suction stroke. Special aerating conduits are therefore not needed. Thus, with the aid of the inventive wall element, a construction wall can be manufactured together with conduits, and subsequently unobjectionable arrangement and connection of the objects as desired by a consumer can be provided. By the utilization of the inner hollow of the inventive wall element it is possible, for example, to arrange a water closet at a remote point of a descending conduit, which has encountered problems in the prior art constructions. The height of the required connecting point in the region of the inner hollow can be selected practically of any magnitude, within the area occupied by this inner hollow. The required bores in the wall element which lead to the inner hollow are produced directly in situ. The wall element in accordance with the invention can be a component of not supporting or curtain parition. It is particularly advantageous when it is utilized for partitions between a kitchen and a bathroom. Finally the gas-tight and watertight inner hollow has the advantage in that horizontal supply conduits may also be arranged therein, so that in the event of insufficient tightness in such a tubular conduit, no water in floors or walls or living space can take place, but it will be drained.

In accordance with another feature of the present invention, the wall element is completely constituted of a shrinkage-free ceramic foam material, particularly of a ceramically bound expanded clay body. The latter has a density of at least 0.5 g/cm$^3$, and the wall of the inner hollow is gas-tight and water-tight. Such a material is noninflammable, possesses salient chemical resistance in alkaline and acid region, and has the required strength so that it simultaneously can serve as a supporting material for any partition wall. Such a wall element can be produced with high accuracy of fit and connected by ceramic glue with a surrounding wall structure, or in some cases also by mechanical pull rods and the like. Furthermore, this material forms an excellent support for flowable, gypsum and cement mortar which also can be fiber-reinforced, particularly for increasing the resistance to pulling action of the material. A further essential advantage of this material is that it is completely free of shrinkage, since such a material does not have hydraulic binding means.

In accordance with still another feature of the present invention, the walls of the inner hollows are coated with a smooth particulate layer which is particularly constituted of ceramic glaze. Such protective layer and particularly such a glaze has very low micro-roughness and is thereby anti-adhesive and practically service-free. The thus produced inner hollow is suitable for all drainages without difficulties. It is also possible to utilize the protective layer which is constituted of a synthetic plastic material, for example of thermo setting, plastic or elastomeric synthetic material. The latter simultaneously provides for an additional sound insulation. The ceramic glaze may be produced by sealing of the upper face of the material of the wall element during its manufacture in heating process, or may be sintered on the latter afterwards.

In accordance with the further feature of the present invention, the inner hollow may be formed by a plurality of substantially horizontal inclined individual channels which are connected with one another by upright connecting channels.

In accordance with the further embodiment, the wall element may have a vertical connecting conduit, which is preferably formed by a substantially vertically extending further inner hollow, so that the horizontally extending hollow or hollows open into the vertically extending inner hollow. Advantageously, such a vertical connecting conduit or descending conduit is provided in the region of the corner of one of the elements. In this case it is advantageous when the latter element has an angle and is formed by two armed portions each provided with a horizontal inner hollow, whereas, the vertical inner hollow is located centrally of the horizontal inner hollows. Such a wall element can be installed in a water-using unit as a cornered element with a descending conduit, and can be easily connected with further wall members in accordance with the invention. Particularly when the wall element is constituted of ceramic foam material, the members forming this wall element can be tightly and simply connected with one another, for example, by a ceramic glue or mechanically by pull rods or the like.

In accordance with still another feature of the present invention the wall element can be assembled of several wall members each provided with at least one horizontal inner hollow and arranged so that the inner hollows merge into one another with a continuous unidirectional inclination. In dependence upon the water-using unit to be erected, the wall element can be manufactured and assembled from the wall members in modulus form each having a height of 60 centimeters, a thickness from 15 to 30 centimeters. The wall members may have a width of substantially 1.20 meters which convenient for assembling purposes in situ, so that on each wall member for example two water basins can be connected and mounted. The connection of such wall elements which are formed as structural blocks is particularly advantageous when these wall elements are constituted of ceramic foam material, because this provides for high accuracy of fit and practically seamless connection with the aid of ceramic glue. The wall members can also be connected by horizontally extending pull rods or similar mechanical means with interposition in some cases of flat seals or other simple suitable sealing means. The wall elements are manufactured with inner hollows which have inclinations following one another, and then are arranged in respective sequence. This also makes possible to provide for a great variety of connection possibilities.

The inventive wall element may be further connected with further conduits. In accordance with yet a further feature of the present invention odor-sealing means may be provided in or on the wall element, or in or on the wall members of the wall element. Such odor-sealing means for sanitary objects may be formed or arranged in and on the wall element of the wall member, and constituted of the same material of which the wall element is constituted. It is particularly possible in the shielded annular wall member to simultaneously incorporate a floor drainage into the wall element which communicates with the vertical inner hollow.

In accordance with still another feature of the present invention, mounting of the wall elements or the wall blocks in an outer wall or walls of the construction is performed with the aid of sound absorbing mats. Thereby, the transmission of noise between the wall element and the construction is reduced to a minimum.

Both for the connection and particularly for unobjectionable and easy draining, it is advantageous where, in accordance with a further feature of the present invention, the horizontal inner hollow has an approximately trapezium shaped cross-section whose short side is rounded and forms a sole. It is advantageous to provide a radius of curvature of the sole of about 25 millimeters, and the inner hollow of a cross-section with a width increasing upwardly to about 100 millimeter. Such a hollow can be provided in a wall with conventional thickness of 120 millimeters without difficulties. The height of the inner hollow in accordance with the invention amounts advantageously to about 500 millimeters which includes practically all connection possibilities, particularly with the highest possible connecting point for a wash basin odor-seal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a view showing a partially sectioned perspective view of a wall of a water-using unit, formed by a wall element in accordance with the present invention.

DESCRIPTION OF THE PREFERRED EMBODIMENTS

A wall element in accordance with the present invention is composed of three block members which are identified by reference numerals 1, 2 and 3. The block members 1 and 2 of the wall element are parallelepiped-shaped. Each of the block members 1 and 2 have a region which serves for connecting sanitary objects. This region is provided with substantially horizontally extending channel-shaped gas-tight and water-tight inner hollow 4. The shape and cross-section of the inner hollow 4 is clearly shown in the block member 1. Each channel or hollow 4 has an approximately trapezium shaped cross-section with a longer side and a shorter side. The shorter side is rounded and forms a sole 4*a*. The sole 4*a* has an inclination which can be seen particularly in the block member 2. The cross-section of the inner hollow increases upwardly so that the upper longer side is twice as wide as the lower shorter side of the same. Thereby, the inner hollow 4 has a shape which is especially advantageous for the connection of sanitary objects.

The block member 3 is angular and has two portions 3*a* and 3*b* extending at an angle relative to one another. Each portion 3*a* and 3*b* is also provided with the horizontally extending inner hollow 4. The horizontally extending hollows of the block members 1 and 2 merge and are open into the horizontally extending hollow 4 of the portions 3*a* and 3*b* of the block member 3.

An approximately vertically extending further inner hollow 5 is provided in the block member 3, and more particularly in its corner region. The inner hollow 5 has here a circular cross-section and is open into the horizontally extending inner hollows 4 of the portions 3*a* and 3*b*, as can be clearly seen in the drawing.

The above mentioned block members, and further inner members which are arranged on the block members 1 and 2 are so shaped and connected with one another that they provide for continuous unidirected inclination or fall of the sole 4*a*.

It is shown as an example that two connecting holes 6 and 7 are provided in the block member 3, the holes being open in the above mentioned inner hollow 4 when the block members are connected with one another or the total wall element is assembled. These holes can be easily produced, for example by milling, in accordance with the required position of the sanitary objects to be connected. The example shown in the drawing clearly demonstrates that a large space is available for the dimension and arrangement of such connecting holes, inasmuch as the inner hollow 4 extends over the total connecting region for such sanitary objects.

The block members 1, 2 and 3 and thereby the wall elements composed thereof are constituted of a shrinkage-free ceramic foam material. Advantageously they are constituted of a ceramically bound expanded clay body having a density of at least approximately 0.5 g/cm$^3$. Advantageously, the wall of each inner hollow 4 is gas-tight and water-tight. For example, it is provided with a smooth coating layer of sintered ceramic glaze.

As can further be seen from the drawing a floor drainage 8 is formed in the wall element as provided in a bordering floor member 9 in a simple manner, so as to be connected with the inner hollows 4 or 5. For this purpose, the block members 1, 2 and 3 with their inner hollows 4 are so inserted in the floor member 9 that the soles 4*a* are located below the upper edge of the floor member, so that all connections of the object including the floor drainage can be accommodated in any spatial arrangement.

It can further be seen from the drawing that the mounting of the block members in a structural unit, such as in the floor member 9 is performed with the aid of sound-absorbing mats 10. The outer walls of the block members are embedded in the sound-absorbing mats 10.

Thus, in accordance with the invention the drainage problem for water-using units, is solved in a very simple manner. Special pipes of circular cross-section are eliminated, and any arrangement and dimension of connections for sanitary objects can be provided. Simultaneously, a required descending line or duct can be formed with the aid of the vertical inner hollow 5, the line serving as an upward extending ventilation pipe.

The individual block members can be easily connected with one another tightly, and they can simultaneously form the lower part of a curtain partition of the structural unit. Such partitions can be manufactured with the inclusion of the wall element of the invention, without consideration of the spatial sanitary objects, and incorporated in a carcase. After this, the sanitary objects are arranged in desired manner and location in association with the inner hollows 4.

It is possible, by the provision of respective dimensions and design of the inner hollows 4, to lay supply conduit inside the inner hollows 4. On the other hand, it is of course possible to insert and embed the supply conduits inside the wall element in desired manner, when they are not provided in further wall elements. In some cases, a connecting rod may be arranged in the inventive wall element or block members, whereby the wall element can be mechanically tightly joined and tightened.

When the wall element is to be utilized in condition of low working requirements, other suitable materials may be used, particularly polyester resin foam material or polyurethane integral foam material. A ceramic bound expanded clay described in German Pat. No. 1,914,372 may be utilized as ceramic foam material.

It will be understood that each of the elements described above, or two or more together, may also find a useful application in other types of constructions differing from the types described above.

While the invention has been illustrated and described as embodied in a construction it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wall element for a construction wall to be associated with sanitary objects, comprising a body portion completely constituted of a self-supporting shrinkage-free ceramic foam material; and means for forming at least one conduit for draining water, said conduit forming means including a channel-shaped gas-tight and water-tight inner hollow which is substantially horizontal and having an inclined sole, said substantially horizontal inner hollow extending over a region of said body portion, which normally serves for the connection of a plurality of sanitary objects to be differently arranged relative to the construction wall, and having a height corresponding to the region of the requisite draining lines of said differently arranged sanitary objects, so that said different sanitary objects can be connected with the same inner hollow and thereby it is not necessary to provide a plurality of separate individual inner hollows for individual connection.

2. A wall element as defined in claim 1, wherein said shrinkage-free ceramic foam material had density which is at least equal to approximately 0.5 $g/cm^3$.

3. A wall element as defined in claim 1, wherein said body portion has wall sections bounding said inner hollow and being gas-tight and water-tight.

4. A wall element as defined in claim 3, and further comprising a smooth protective layer covering said wall sections of said body portion, which bound said inner hollow.

5. A wall element as defined in claim 4, wherein said protective layer is constituted of ceramic glaze.

6. A wall element as defined in claim 4, wherein said protective layer is constituted of synthetic plastic material.

7. A wall element as defined in claim 1, wherein said inner hollow includes a plurality of substantially horizontally extending passages having an inclination and upright connecting passages which connect said substantially horizontally extending passages.

8. A wall element as defined in claim 7, wherein an upright connecting passage is formed as a substantially vertically extending further inner hollow, said horizontally extending inner hollow or hollows being open into said substantially vertically extending further inner hollow.

9. A wall element as defined in claim 1, wherein said body portion is provided with a plurality of block members, each provided with at least one of said inner hollows, said inner hollows being arranged so that they communicate with one another and extend with continuous unidirected inclination.

10. A wall element as defined in claim 1; and further comprising means for mounting the wall element in an outer wall of the construction.

11. A wall element as defined in claim 10, wherein said mounting means includes a sound-absorbing mat.

12. A wall element as defined in claim 1, wherein said inner hollow has a trapezium-shaped cross-section including an upper longer side, and a lower shorter side forming the sole of said inner hollow.

13. A wall element for a construction wall to be associated with sanitary objects, comprising a body portion constituted of a self-supporting material and formed as an angular member having two arm sections extending at an angle relative to and connected with one another; and means forming at least one conduit for at least draining water, said conduit forming means including a channel-shaped gas-tight and water-tight inner hollow provided in a region of said body portion, which normally serves for the connection of said sanitary objects, said inner hollow having an inclined sole and a height corresponding to the region of the requisite draining lines of said sanitary objects, said inner hollow including a plurality of substantially horizontally extending passages with an inclination and a substantially upright passage in which said horizontal passages are open and which connects said horizontal passages with one another, each of said horizontally extending passages extending through a respective one of said arm sections, whereas said upright passages being arranged centrally of the latter.

* * * * *